US008549778B2

(12) United States Patent
Ahlberg

(10) Patent No.: US 8,549,778 B2
(45) Date of Patent: Oct. 8, 2013

(54) DEVICE AT A PORTABLE DISPLAY PANEL SYSTEM

(76) Inventor: Christian Ahlberg, Sollentuna (SE)

( * ) Notice: Subject to any disclaimer, the term of this patent is extended or adjusted under 35 U.S.C. 154(b) by 0 days.

(21) Appl. No.: 13/404,065

(22) Filed: Feb. 24, 2012

(65) Prior Publication Data

US 2012/0216437 A1 Aug. 30, 2012

(30) Foreign Application Priority Data

Feb. 25, 2011 (SE) ..... 1150175

(51) Int. Cl.
*G09F 17/00* (2006.01)

(52) U.S. Cl.
USPC ..... 40/603; 40/604; 248/165

(58) Field of Classification Search
USPC ..... 248/165; 40/603, 604, 610; 403/361, 403/109.1, 109.5, 292, 299, 303, 309–311
See application file for complete search history.

(56) References Cited

U.S. PATENT DOCUMENTS

| | | | | |
|---|---|---|---|---|
| 2,317,729 | A * | 4/1943 | Bruno | 285/377 |
| 4,700,498 | A * | 10/1987 | Perutz et al. | 40/603 |
| 5,749,592 | A * | 5/1998 | Marchetto | 280/292 |
| 6,718,669 | B1 | 4/2004 | Hayes | |
| 2008/0005945 | A1 * | 1/2008 | Fritsche et al. | 40/603 |

FOREIGN PATENT DOCUMENTS

| | | |
|---|---|---|
| FR | 2 759 880 | 8/1998 |

* cited by examiner

*Primary Examiner* — Casandra Davis
(74) *Attorney, Agent, or Firm* — Jeffrey S. Melcher; Manelli Selter PLLC

(57) ABSTRACT

Provided is a portable display panel system including a rack, upper and lower rods having pairs of upper and a lower holder ribs, and a cloth or a panel of a printable material. Each of the rods has a through-cavity. An elastic string extends through each of the upper and lower holder ribs and is attached to the outer ends of the outermost rods. Male and female couplings are arranged at the abutting ends of the rods arranged in pairs, which may be brought together in either two positions, which are turned by 180°, or four positions which are turned by 90° relative to each other. At least one pair of the rods are bent or angled.

6 Claims, 12 Drawing Sheets

DEVICE AT A PORTABLE DISPLAY PANEL SYSTEM

The present invention relates to a device at a portable display panel system according to the pre-characterizing portion of claim 1.

PRIOR ART

U.S. Pat. No. 6,718,669 describes a display panel system of the kind mentioned above. These systems are complex and hence difficult to mount rapidly or to change for adaption to new exhibition areas. It is also associated with certain time consumption to raise/mount and dismount display panels of this kind. An additional display panel system of this kind is shown in FR 2 759 880. Both these known panel systems consist of uniform upper and lower ribs, which limit the variation of the display panel system.

THE OBJECT OF THE INVENTION

The object of the invention is to provide a device at a display panel system which eliminates the drawbacks mentioned above and which at the same time is easy to mount and dismount for transport as well as which is simple in its construction and function.

BRIEF DISCLOSURE OF THE INVENTION

The object is achieved with a device at a display panel system according to the characterizing portion of claim 1.

The sub-claims relate to advantageous embodiments of the invention.

The upper and lower rods, which are connected with each other, have straight as well as bent as well as angled shapes and support the fabric panel having a graphic print or the like. As the upper and lower tubular rods, which are connected, have different shapes and are kept together by a combination of specially shaped end pieces and the string which has been put through all rods, a display panel is achieved which is both easy to handle, i.e. to mount and dismount and also easy to change as to shape.

DESCRIPTION OF DRAWINGS

The invention is described more in detail below with reference to the enclosed drawings, which show preferred embodiments.

DESCRIPTION OF PREFERRED EMBODIMENTS

Figure 1:
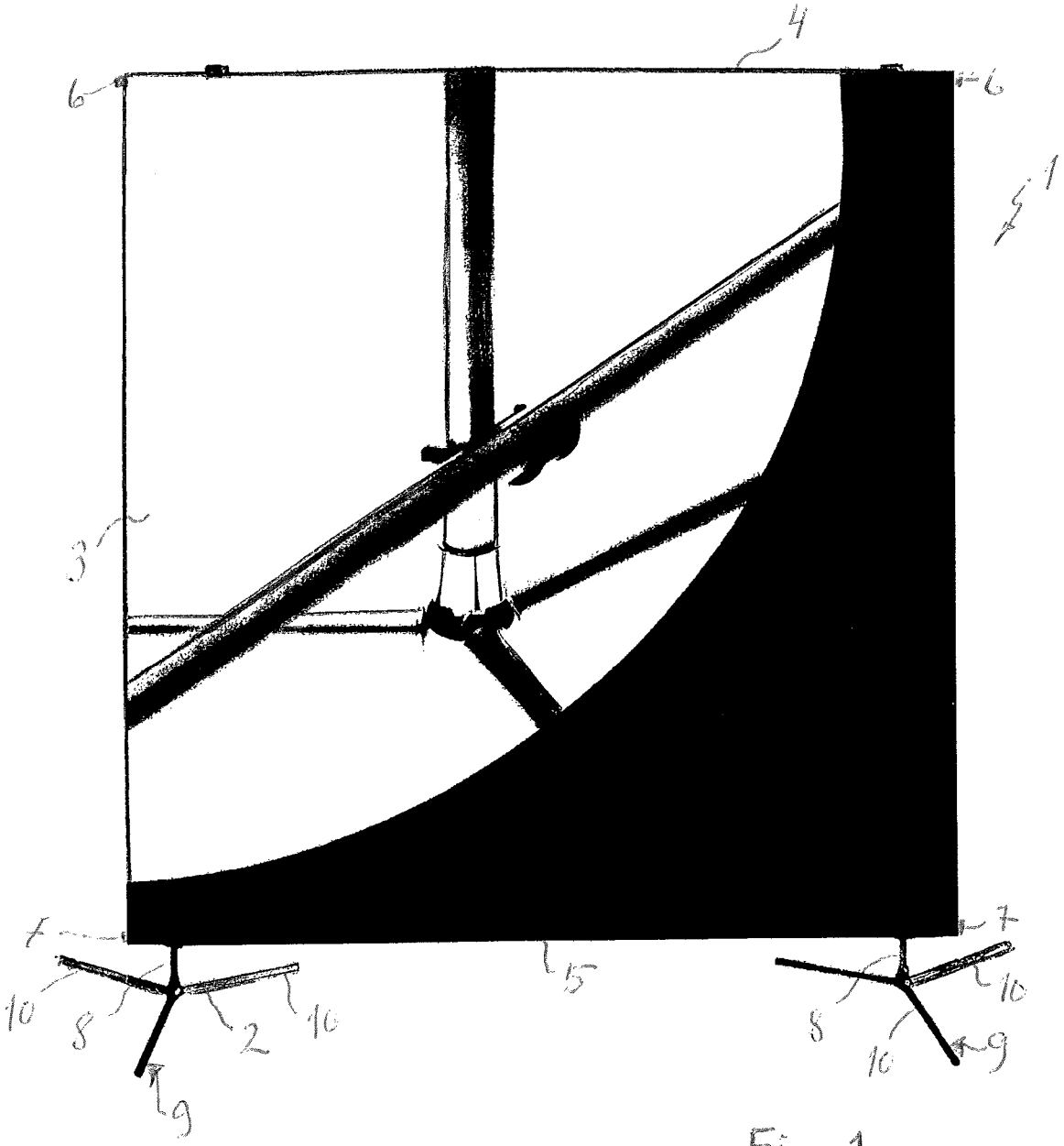
FIG. 1 shows a perspective view of a first embodiment of a display panel system with a device according to the invention.

Similar parts/details of the embodiments described and shown in the drawings have been denoted with the same reference numbers.

FIG. 1 shows a display panel system 1 with a supporting rack 2 and on the rack a supported and stretched cloth 3 or a panel of a flexible and elastic material, such as fabric, which has been provided with a graphic print. At the upper edge 4 and the lower edge 5 of the panel there are holder ribs 6 and 7, respectively, arranged in channels in the fabric which are sewn or manufactured in any other way, which ribs are included in the rack 2. The holder ribs 6, 7, which are parts of the device according to the invention, will be described more in detail below. As is partially shown in FIG. 1, the rack has telescopic props 8, which are attached to foldable floor supports 9 consisting of three legs 10 extending in three different directions.

Figure 2:
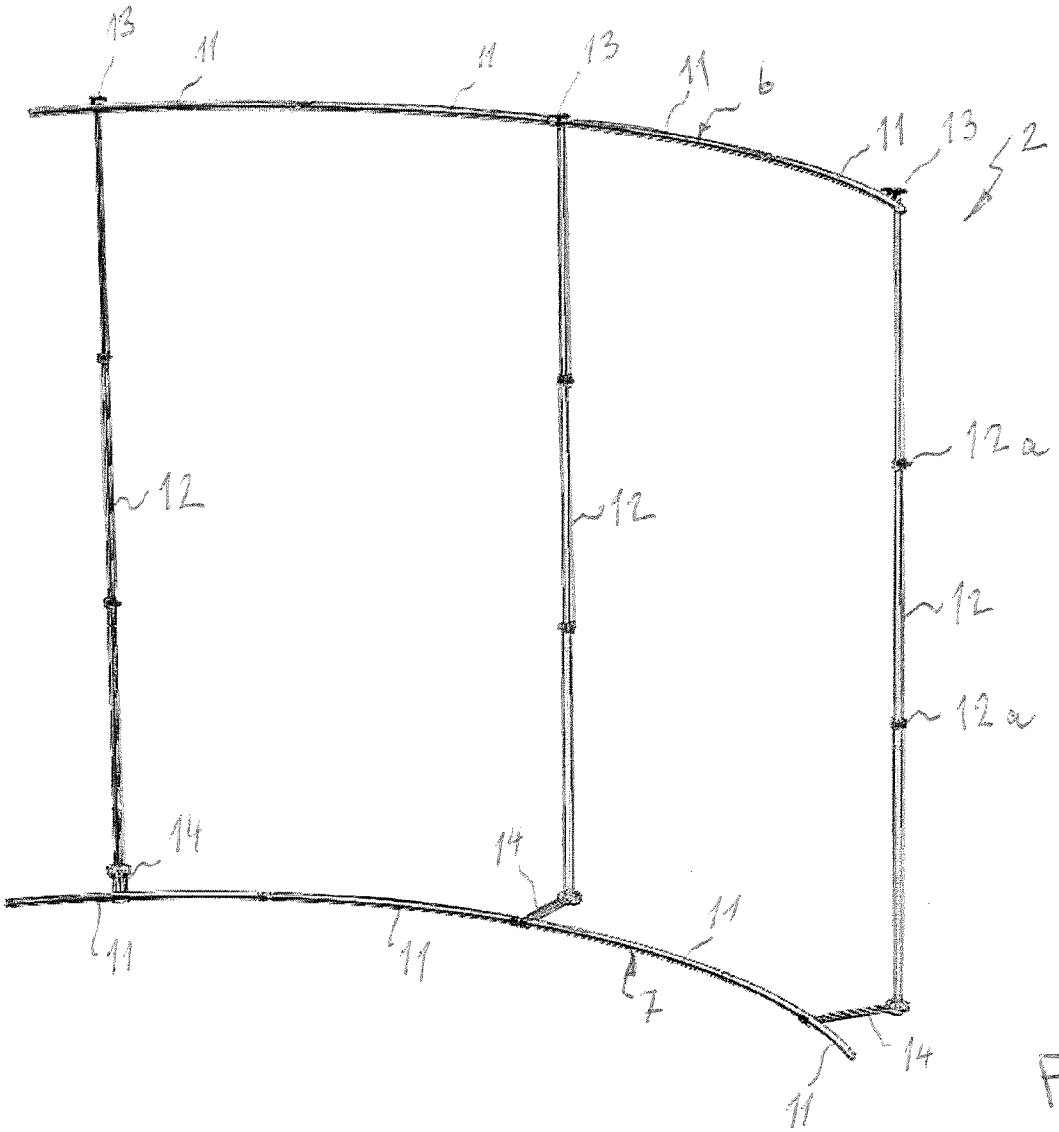
FIG. 2 shows a perspective view of a second embodiment of a rack for a display panel system with a device according to the invention, but with the panel removed for the sake of clarity.

FIG. 2 shows a rack 2 for a panel 3 included in the display panel system 1 having a device according to the invention. The device according to the invention in principle consists of the upper holder rib 6 and the lower holder rib 7. These holder ribs comprise at least two rods 11 each, each one having a straight, angled or bent shape. FIG. 2 shows upper and lower holder ribs 6, 7 with four rods 11 each. Opposite rods 11 of the upper and lower ribs 6 and 7 have, however, always substantially the same shape as to their longitudinal extension, as, at the assembly of the panel on the ribs, the panel should at every point along its longitudinal extension have a substantially vertical extension between the upper and lower ribs 6, 7. For the sake of clarity, the panel 3 has been removed in this figure as well as in the subsequent figures. In this embodiment, the upper and lower ribs consist of four bent rods 11, which have been brought together and connected. The upper and lower ribs 6 and 7 are supported by three props 12, which may preferably be telescopically brought together, and which are connected with the ribs 6 and 7 by means of holders 13 and 14, respectively, which are described more in detail below. The props 12 consist in this embodiment of three telescopically movable parts each with clamping means 12*a* for locking in the desired position. The number of props 12 may, of course, be varied depending on the size of the rack 2 as to its height and width extension.

Figure 3:
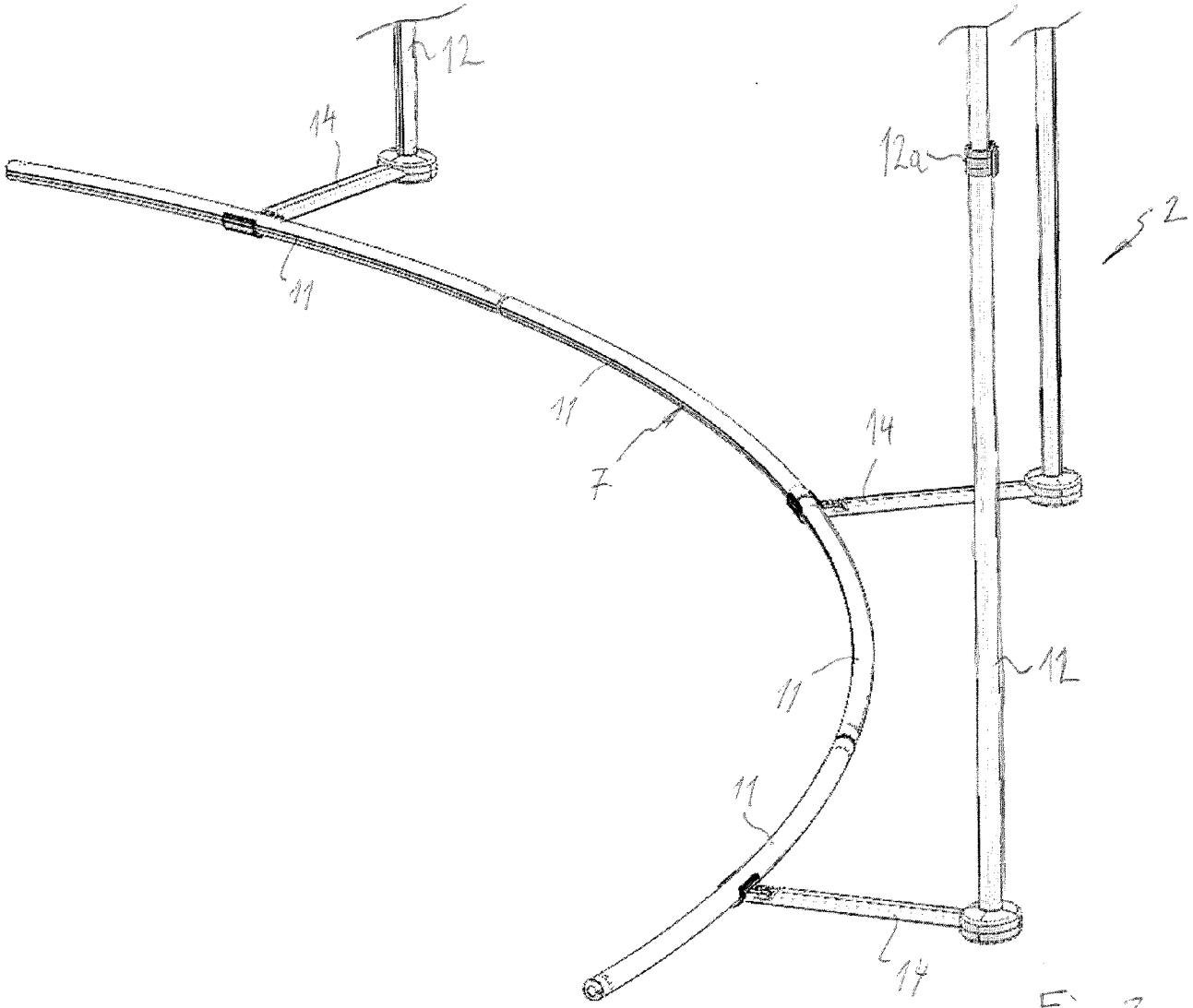
FIG. 3 shows an enlarged partial perspective view of the lower part of the rack in FIG. 2.

FIG. 3 shows the lower part of the rack 2 in FIG. 2. The lower rib 7 including the four bent rods 11, which are connected with each other, is kept by the holders 14 of the rack 2 which are attached to the props 12.

Figure 4:
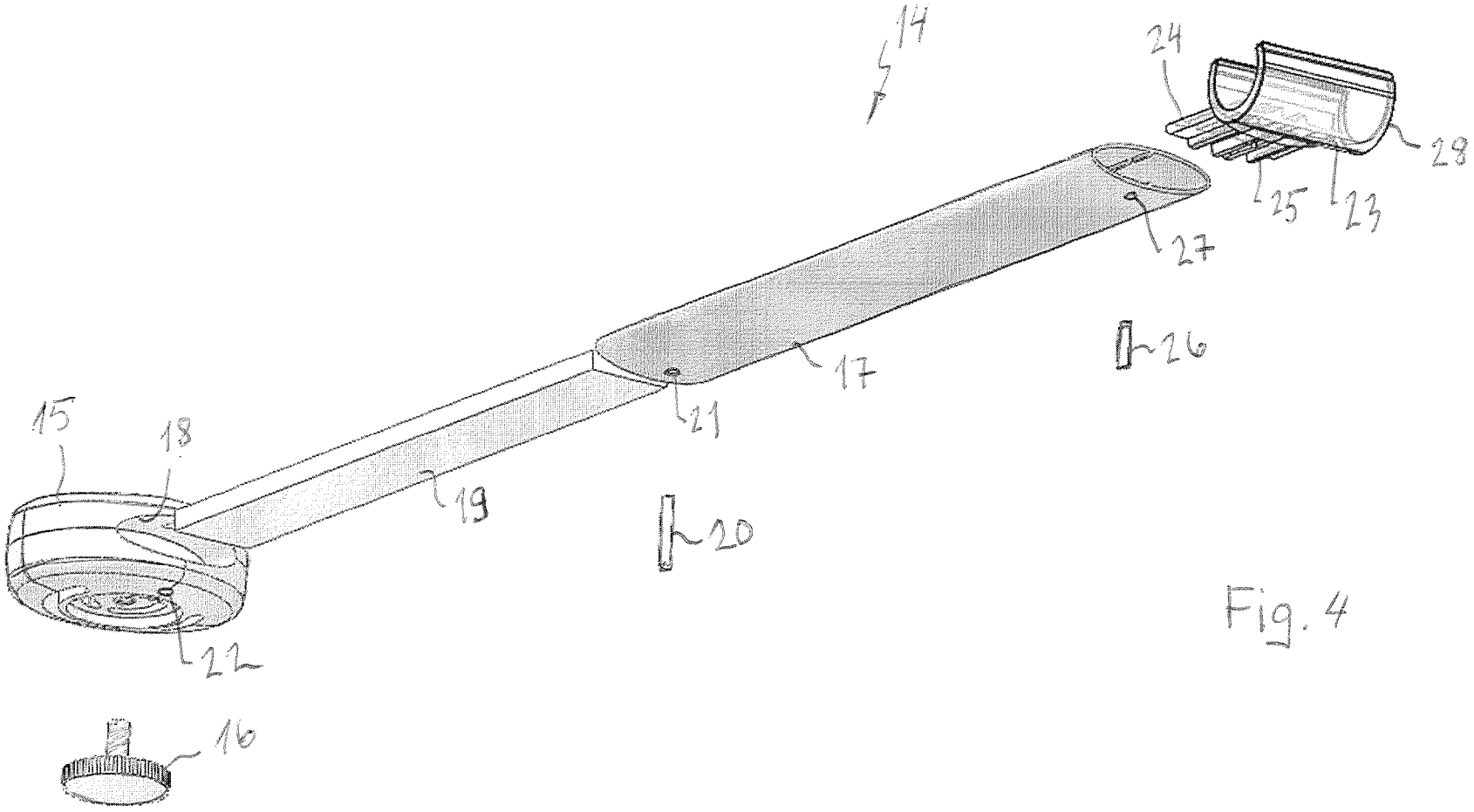
FIG. 4 shows an enlarged exploded view in perspective of a lower holder means, included in the lower part of the rack in FIG. 3.

FIG. 4 shows an exploded view of a holder 14. An annular end piece 15 is with a screw 16 screwed in a threaded hole in the lower end of each prop 12. A tube 17 with an oval cross-section is inserted in a mating recess 18 in the side of the end piece 15 and fixed therein by a pin or a screw 20, which is arranged to be inserted through holes 21 and 22. The other end of the tube 17 receives a protruding tongue 24 of a first holder 23, which tongue has flexible flanges 25, see FIG. 5, for abutment against the inside of the tube 17. A pin 26 or a screw is inserted into a hole 27 in the tube 17 and fixed against the tongue 24. The lower rib 7 with the cloth 3 mounted thereon is detachably snapped to the outer snapping part 28 of the first holder 23. A weight bar 19, preferably of metal, is inserted inside the oval tube 17 for stabilisation of the rack 2 in the assembled state.

Figure 5:
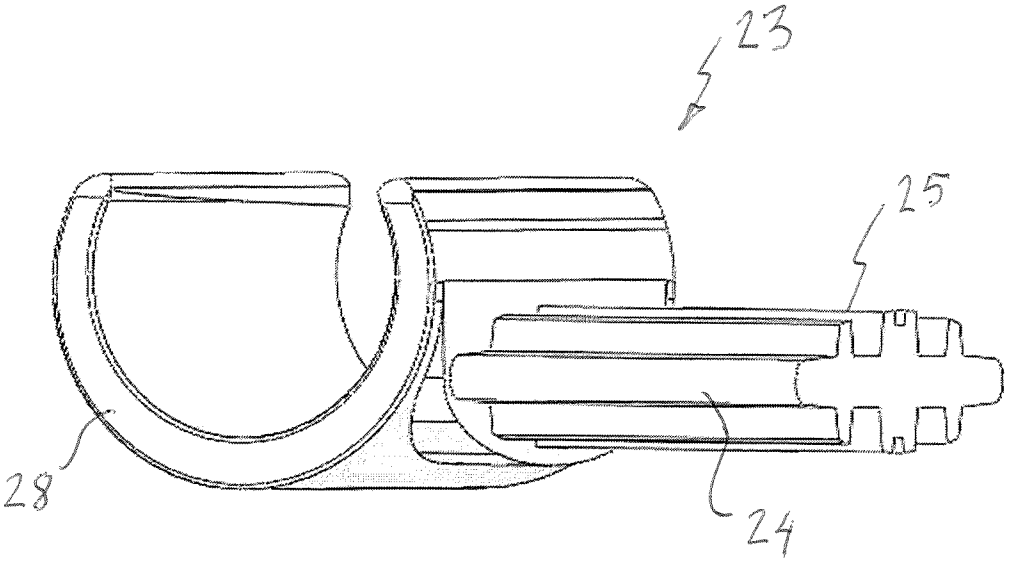
FIG. 5 shows a perspective view of a tube holder of the holder means in FIG. 4.

FIG. 5 shows an enlarged view of the first holder 23, wherein the resilient flanges 25 extending in the longitudinal direction of the tongue 24 with prestress abut against the inside of the tube 17.

Figure 6:
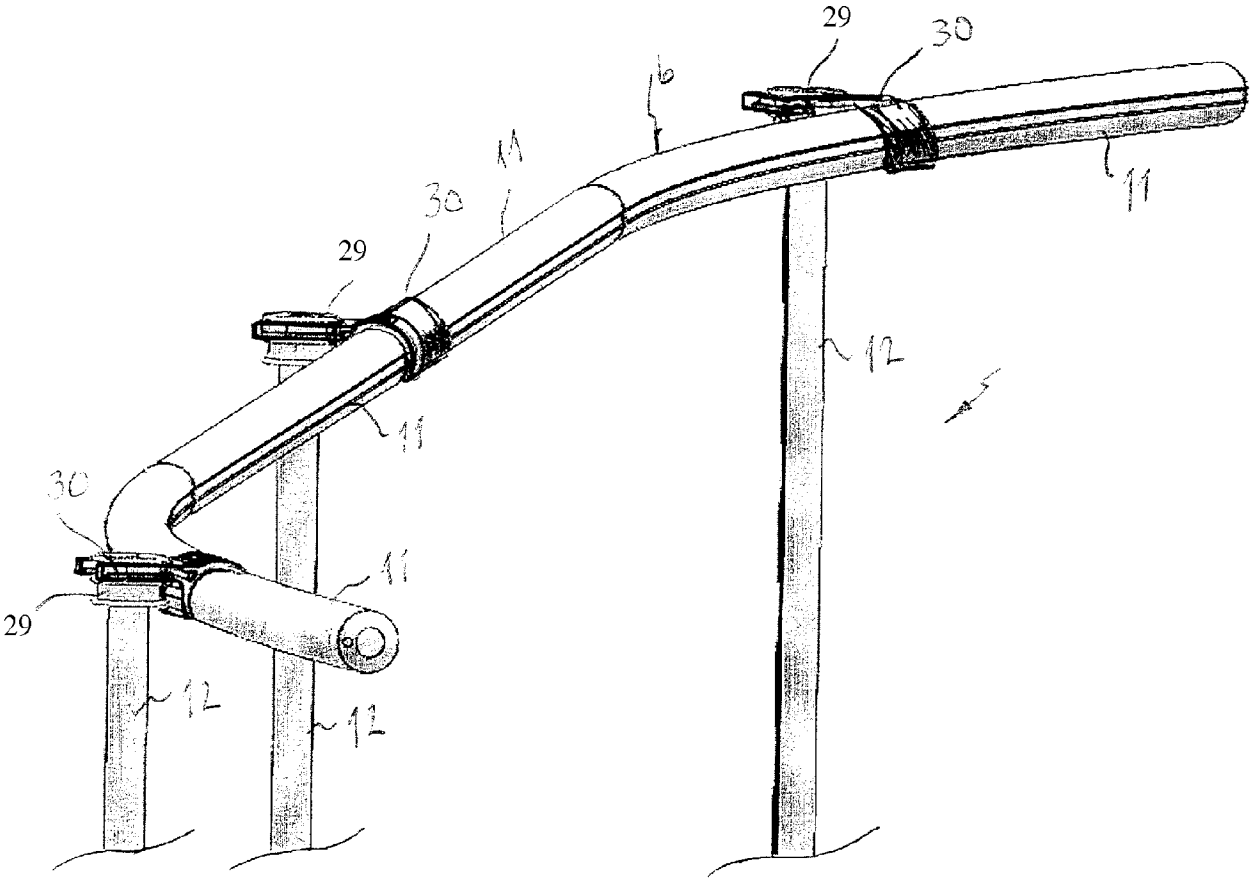
FIG. 6 shows an enlarged partial perspective view of the lower part of a third embodiment of the rack.
Figure 7:
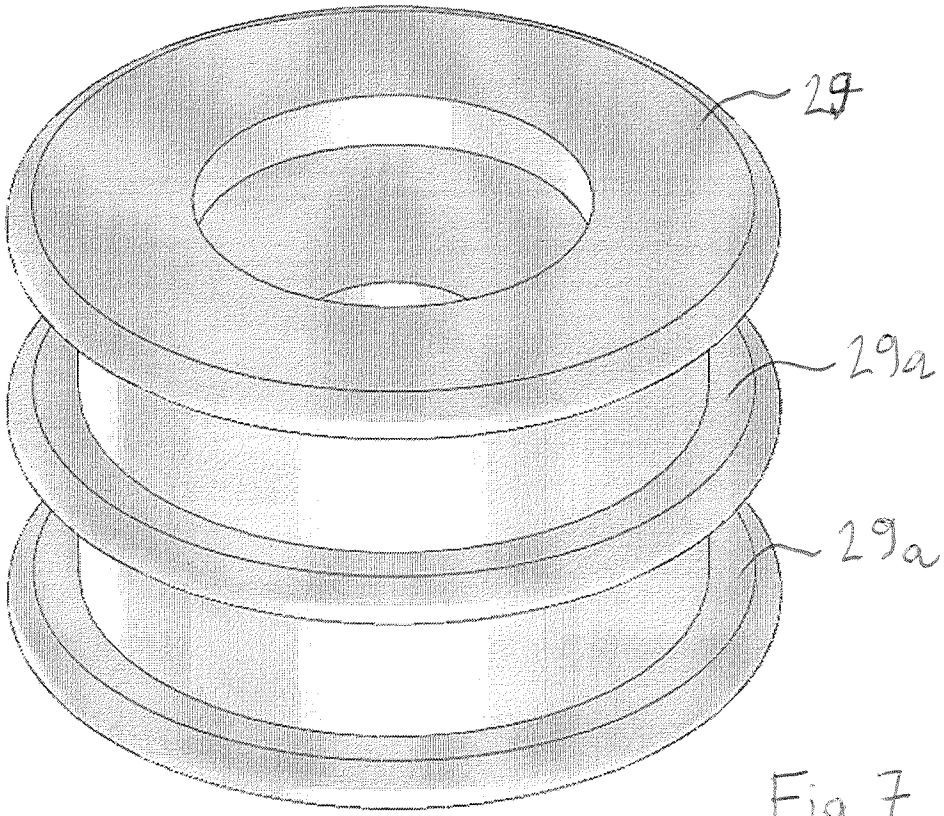
FIG. 7 shows an enlarged perspective view of an annular holder included in the upper part of the rack.
Figure 8:
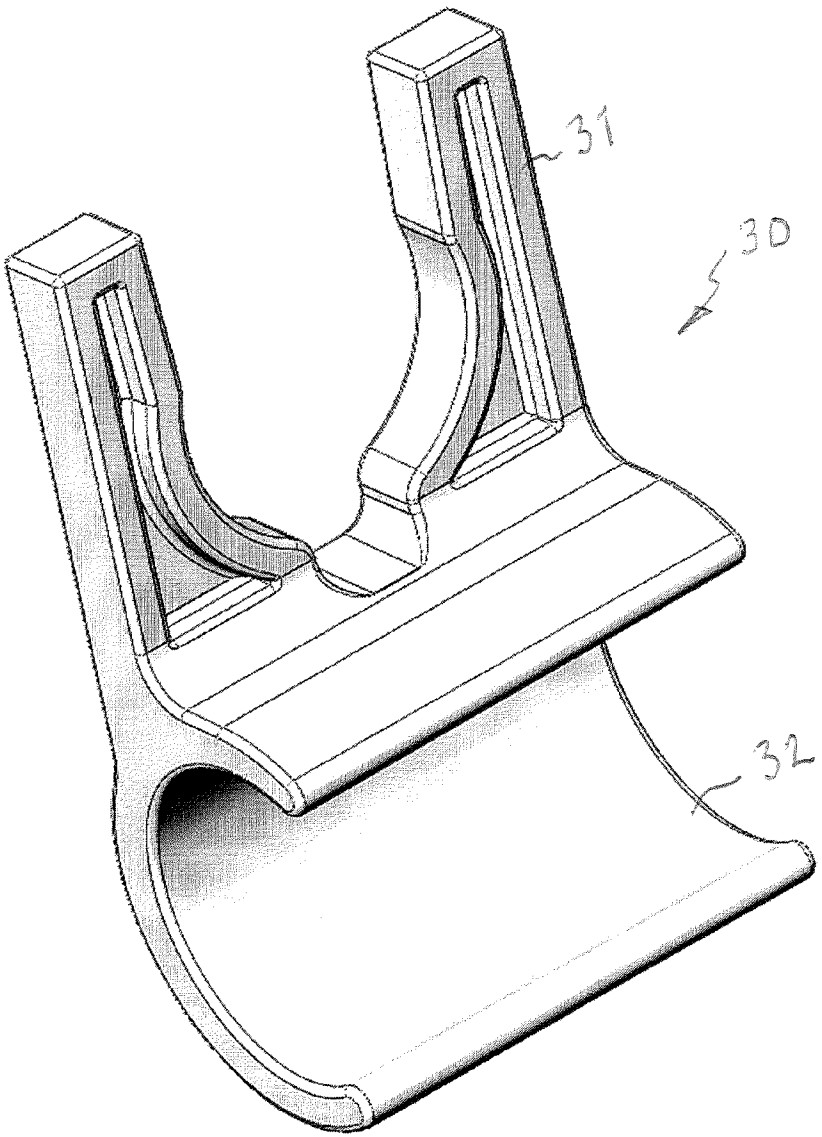
FIG. 8 shows a holder for the connection of the holder in FIG. 7 and the rods included in the rack.

FIG. 6 shows an upper part of the rack 2, where the upper rib 6 comprises four rods 11, of which the outer rods are bent and the inner rods are straight. The lower rib, not shown, in this embodiment of the rack 2 has the same kind of rods 11, i.e. two outer bent ones and two inner straight ones, which are arranged in the same order along the ribs. At the upper end of each prop 12 an annular groove holder 29, see FIG. 7, has been mounted with two annular grooves 29*a* arranged above each other. In FIG. 8 a second holder 30 is shown consisting of a fork-shaped part 31 and a snap-in part 32. The fork-shaped part 31 is snapped in one of the grooves 29 of the annular groove holder 29. The snap-in part 32 is snapped over the upper rib 6 with the cloth 3 mounted thereon. The groove holder is provided with double grooves to be able to receive ribs with a cloth at the opposite side. In such a case a double-sided display panel system is assembled. The upper rib 7 with the cloth 3 mounted thereon is detachably snapped in the outer snap-in part 32 of the second holder 30.

In FIGS. 9 to 12, the function and the construction of the device according to the invention with a display panel system 1 is described.

Figure 9:
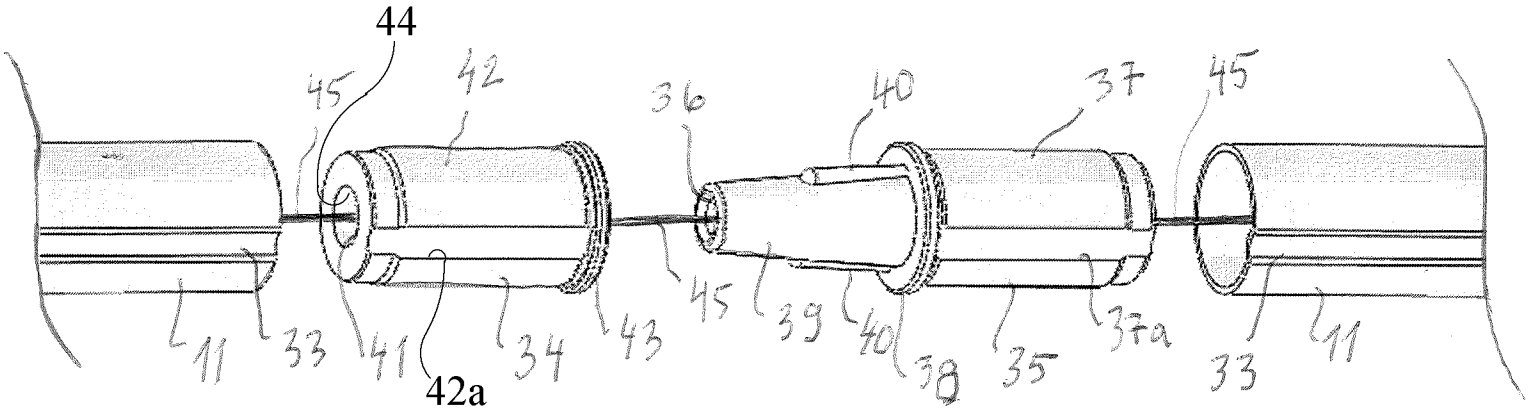
FIG. 9 shows an exploded view in perspective of rods with male and female couplings.

In FIG. 9 the coupling of two straight rods 11 is shown. The rods 11 have an irregular cross-section, which is here shown through an indentation 33 extending along the length of the rods 11. The irregular cross-section of the inner cavity of the rods is adapted with mating shape to receive a female coupling 34 and a male coupling 35, respectively. The male coupling 35 has a through-hole 36, an end part 37 mating the inner shape of the rod 11, which end part has an indentation 37*a* and is fixed to the rod 11 in a suitable manner, an annular collar 38 which is arranged to abut against the end surface of the rod 11, and a conical male part 39, which has ridges 40 on each side. The female coupling 34 has a through-hole 41, an end part 42 mating the inner shape of the rod 11, which end part 42 has an indentation 42*a* and is fixed to the rod 11 in a suitable manner, an annular collar 43, which is arranged to abut against the end surface of the rod 11, and a conical recess 44, which has a longitudinal groove 44*a* (see FIG. 11) and which is arranged with shape mating to receive the conical male part 39 with the ridges 40 of the male coupling 35 (see FIGS. 11 and 12). An elastic string 45, preferably of rubber, has been inserted through the rods 11 and the through-holes 36 and 41, respectively, of the male and female couplings. The elastic string 45 is in its ends attached to end pieces 46, see FIG. 12, of the outer ends of the outer rods 11 and is biased at a predetermined prestress. The end pieces 46 are preferably provided with annular magnets to be laterally connected with an additional similar display panel system.

Figure 10:
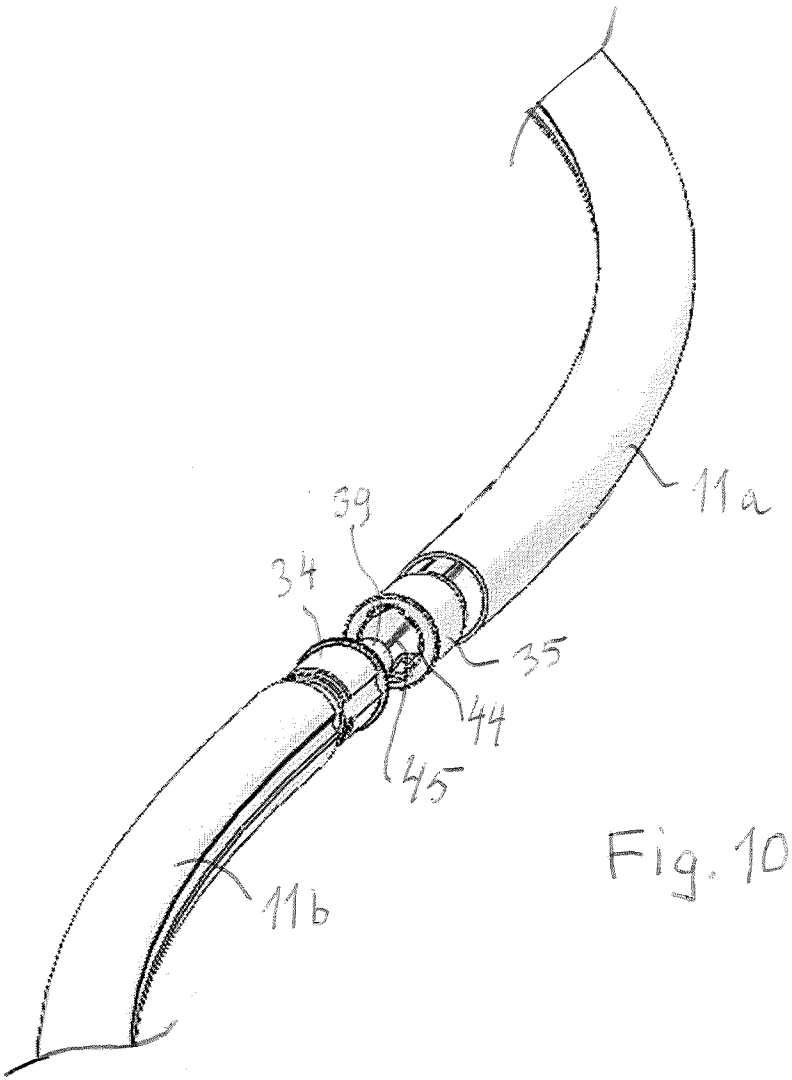
FIG. 10 shows an exploded view in perspective of a fourth embodiment of upper or lower rods included in the rack with male and female couplings.

FIG. 10 shows an embodiment of the device according to the invention, wherein three bent rods 11*a* and 11*b* of a rib 6 or 7 have been separated, as is shown in an exploded view. As may be seen from FIG. 10, the two recesses arranged opposite to each other in the female and male couplings 34 and 35, respectively, with ridges 40 accomplish that the rods 11 are pressed towards each other to a certain relative position. This position may be changed by 180°, if one wants that the cloth and hence the rack shall have another desired extension by a rod being loosened through separation of the couplings 34, 35 of the rods 11*a* and 11*b* and simultaneous separation of the couplings of the rod 11*b* and the next rod, then the rod 11*b* may be turned by 180° and the rods will be dropped so that the elastic string 45 may draw the ends of the rods towards each other so that the ends abut each other again. This operation is performed on corresponding rods 11*b* of the upper as well as the lower rib 6 and 7, respectively. In this way, a different extension of the cloth 3 has been obtained.

The male and the female couplings 34, 35 are with shape mating received and fixed to the abutting ends of the rods 11 arranged as pairs with the upper and lower holder ribs 6, 7. The couplings 34, 35 are so designed that they may be brought together in two positions, which are turned by 180° or in a further development in four positions which are turned by 90° relative each other. At least a pair of rods 11 of the upper as well as the lower holder ribs 6 and 7, respectively, are bent or angled. In this way, different embodiments of the display panel system according to the invention may be achieved. For instance, it may start with a straight panel part, which continuously proceeds into a part turning to a curved part in the direction towards the rear side of the exhibition area. Thereafter, the display panel system may continuously proceed to a panel part which turns back with a curved part and finally it may for instance be ended with a part which at a position along its extension is bent at a predefined angle to, for instance, delimit the exhibition area in relation to a neighbouring exhibition area.

If the couplings may take four positions which are turned by 90° relative each other, a display panel system may be achieved with one part turning upwards or downwards and then resuming the normal plane. In this way, one may build a portal with advertising messages between two departments on the exhibition area.

Figure 11:
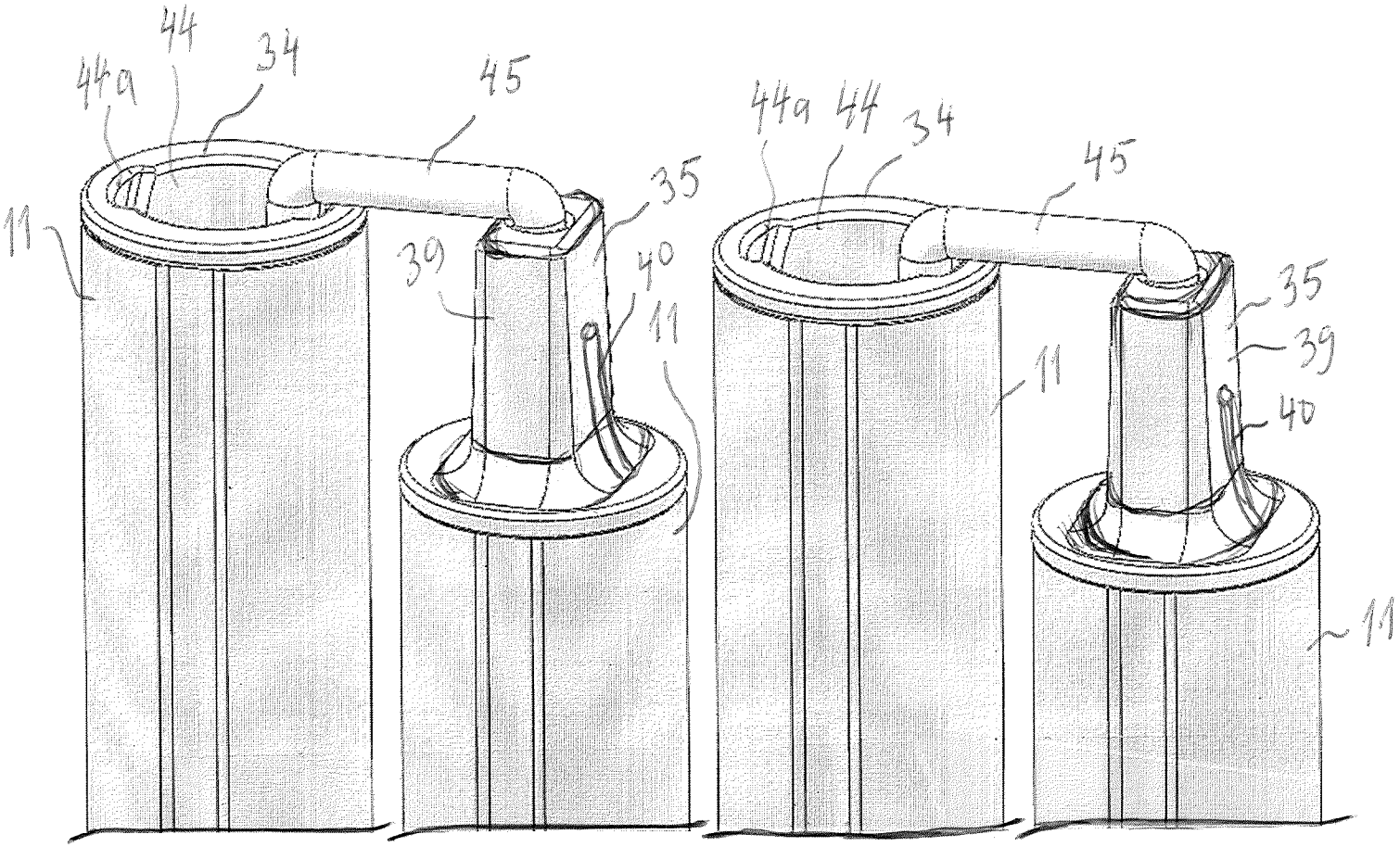
FIG. 11 shows a perspective view of separated and folded straight rods included in the device of the invention.
Figure 12:
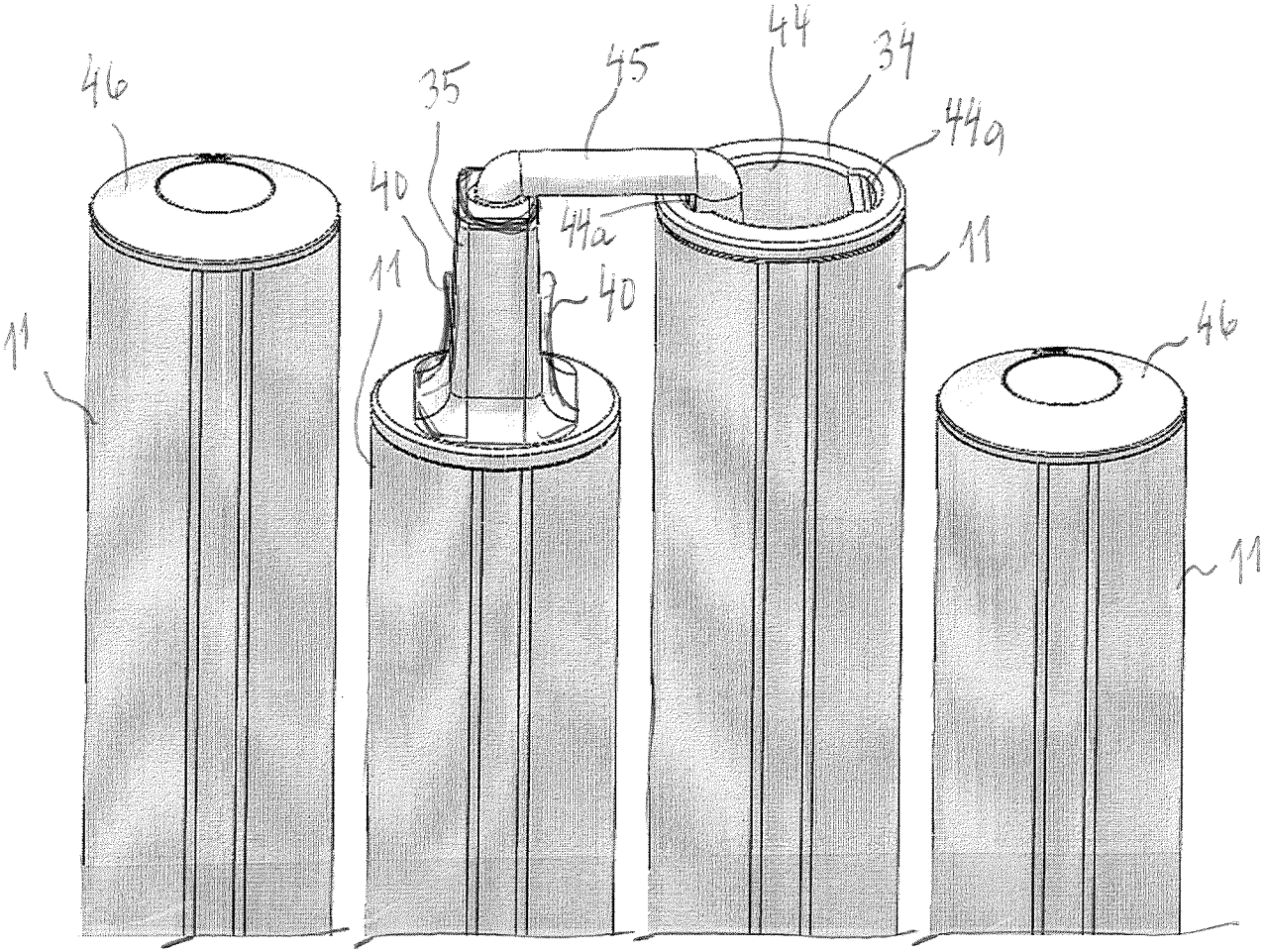
FIG. 12 shows a perspective view of the opposite ends of the separated rods in FIG. 11.

At dismounting a display panel system 1 according to the invention having rods which are slightly curved and/or bent, the rods 11 of the upper and lower ribs 6 and 7, respectively, can be separated by stretching the elastic string 45 so that the female and male couplings 34 and 35, respectively, are released from engagement with each other, whereupon the rods 11 with the cloth or the panel 3 still mounted thereon may be folded so that the rods 11 lies substantially side by side to each other, as is shown in FIGS. 11 and 12. This allows a rapid dismounting and rolling of cloth and rods for transport in a suitable bag or box.

Modifications of the device according to the invention are possible within the scope of the enclosed claims.

The invention claimed is:

1. A device at a portable display panel system comprising:

a rack;

at least one pair of upper and a lower holder ribs included in the rack; and a cloth or a panel of a printable material stretched between said pair of upper and lower holder ribs, said upper and lower holder ribs each comprising at least two longitudinal rods of a predetermined shape, which rods are provided with a through-cavity, wherein an elastic string extends through each of said upper and lower holder ribs, respectively, which strings are attached to ends of the holder ribs, wherein the device comprises male and female couplings, respectively, which with shape adaption are received and fixed to abutting ends of the rods, which are arranged as pairs with said upper and lower holder ribs and are so designed, that they can be brought together in two positions which are turned by 180° or in four positions which are turned by 90° relative each other, wherein at least a pair of the rods of the upper as well as the lower holder ribs are curved or bent.

2. The device according to claim 1, wherein said rods have irregular cross-sections in order to, with shape adaption, receive said male and female couplings, respectively, at their ends which in an assembled state abut against each other.

3. The device according to claim 1, wherein an end piece for the attachment of said elastic string is arranged at the outer ends of said upper and lower holder ribs.

4. The device according to claim 3, wherein each one of said end pieces has a holder for said elastic string at the end facing towards the centre of the rod, and at the other end there is a collar, which abuts against the end surface of the upper and lower holder ribs.

5. The device according to claim 1, wherein said rods have a longitudinal groove which curves inwardly.

6. The device according to claim 1, wherein at least one of said rods is substantially straight.

* * * * *